US006065326A

United States Patent [19]

Frenken

[11] Patent Number: 6,065,326

[45] Date of Patent: May 23, 2000

[54] HYDRAULIC MANUAL DEVICE

[75] Inventor: Egbert Frenken, Heinsberg, Germany

[73] Assignee: Gustav Klauke GmbH, Remscheid, Germany

[21] Appl. No.: 09/117,421

[22] PCT Filed: Sep. 27, 1997

[86] PCT No.: PCT/EP97/05302

§ 371 Date: Sep. 25, 1998

§ 102(e) Date: Sep. 25, 1998

[87] PCT Pub. No.: WO98/24570

PCT Pub. Date: Jun. 11, 1998

[30] Foreign Application Priority Data

Dec. 2, 1996 [DE] Germany ..... 196 49 932

[51] Int. Cl.[7] ..... B26B 17/00

[52] U.S. Cl. ..... 72/453.15; 30/180; 29/751

[58] Field of Search ..... 72/453.15, 453.16; 30/180, 182; 29/750, 751

[56] References Cited

U.S. PATENT DOCUMENTS

| | | | |
|---|---|---|---|
| 3,924,330 | 12/1975 | Mitsuhashi et al. | 30/362 |
| 4,339,942 | 7/1982 | Svensson | 72/453.16 |
| 4,382,331 | 5/1983 | Kimura | 30/180 |
| 4,823,588 | 4/1989 | Bussereau et al. | 72/453.16 |
| 5,111,681 | 5/1992 | Yasui et al. | 72/453.16 |
| 5,195,354 | 3/1993 | Yasui et al. | 72/453.16 |
| 5,282,378 | 2/1994 | Kimura | 72/453.16 |
| 5,425,164 | 6/1995 | El Dessouky . | |
| 5,598,635 | 2/1997 | Saito | 30/362 |
| 5,666,848 | 9/1997 | Burns | 72/453.16 |

FOREIGN PATENT DOCUMENTS

| | | |
|---|---|---|
| 0062206 | 10/1982 | Germany . |
| 19512594 | 10/1996 | Germany . |

*Primary Examiner*—David Jones
*Attorney, Agent, or Firm*—Trexler, Bushnell, Giangiorgi & Blackstone, Ltd.

[57] ABSTRACT

A manual hydraulic apparatus (1) with a traction/pressure installation, for example, a hole punch apparatus, with a hydraulic piston (5) which can be moved with respect to a cylindrical housing (25), and with a holding-up part (2) and a fastening installation (3), for example, for a piercing punch. The fastening installation (3) is rigidly connected to the cylindrical housing (25) and the holding-up part (2) can be moved by the hydraulic piston (5) with respect to the fastening installation (3).

24 Claims, 3 Drawing Sheets

HYDRAULIC MANUAL DEVICE

BACKGROUND

The invention relates to a manual hydraulic apparatus with a traction/pressure installation, for example, a hole punch apparatus, with a hydraulic piston which can e moved with respect to a cylindrical housing, and with a holding-up part and a fastening installation, for example, for a piercing punch.

Different variants of such manual hydraulic apparatuses are already known. One such manual apparatus cannot only be used as a transportable perforation apparatus, for example, for the punching of holes in metal sheets, it can also, in another variant, be used as a blind riveting apparatus. With regard to the latter possibility, reference is made, for example, to the state of the prior art according to EP B1 62 206.

In the known manual hydraulic apparatuses, the design of the traction/pressure installation is not yet considered to be satisfactory.

The hydraulic piston of the known manual hydraulic apparatus retracts, when pressure is applied, pulling the piercing punch to the apparatus, while the holding-up part remains fixed. Accordingly, the admission of the hydraulic piston must be from the front. Because, in addition, the hydraulic piston is still connected to the fastening installation, only a ring surface of the piston is available for the admission pressure. This surface must have the appropriate area, or a correspondingly high hydraulic pressure must be applied.

SUMMARY

Starting from the state of the art described above, the invention concerns the technical problem of improving and simplifying, to the extent possible, the known manual hydraulic apparatus, particularly with regard to its construction.

This technical problem may be solved by one aspect of the present invention, where it is assumed that the fastening installation is rigidly connected to the cylindrical housing and that the holding-up part can be moved by the hydraulic piston with respect to the fastening installation.

In this context, a rigid connection with the fastening installation of the housing itself is crucial. In any case, the fastening installation is here also directly connected to the fixed cylindrical housing. According to the invention, an exchange is made between the movable and fixed part of the drive installation. It was recognized that, in contrast to the principle used so far in such an apparatus, the holding-up part can be actively moved, that is the manual hydraulic apparatus, when used, can be braced against one of the surfaces of the holding-up part, whereas the fastening installation remains fixed. This exchange between the movable and the fixed part makes it possible to use a considerably simpler construction design. The hydraulic piston, when actuated, can receive the admission pressure from the floor. The entire piston surface can be available for this purpose. Since admission pressure need not be applied to the top of the hydraulic pistons, that is the side pointing in the direction of the holding-up part, the design of the apparatus can, as a result, be much more compact. In an additional advantageous variant, the invention provides for a design of the holding-up part which is essentially in the shape of a circular ring. The fastening installation can, to the extent compatible with the known variant, be in a position which is central with respect to the holding-up part. For this purpose it is particularly preferred that the holding-up part passes through the fastening installation. Thus it is possible, in a simple manner, to apply the admission pressure onto the holding-up part by means of the hydraulic piston in spite of the central arrangement of the fastening installation. In greater detail, the hydraulic piston can, for this purpose, pass through the fastening installation by means of pressure rods, which act on the holding-up part. To hold the holding-up part together with a hydraulic piston, other separate screw connections are listed below. Moreover, it is also possible for the pressure rods, if they are properly designed, to take over the task of fastening the parts to each other. In addition, it is preferred that the hydraulic piston is braced by a spring connection to the fastening installation in its resting position. It is sufficient to insert a simple pressure spring between the top side of the hydraulic piston and the bottom side of the fastening installation. Furthermore, a concrete variant also provides, as already discussed in principle, for the possibility of applying admission pressure essentially over the entire surface area of the cross section of the hydraulic piston.

BRIEF DESCRIPTION OF THE DRAWINGS

The invention is explained below with reference to the drawing in the appendix, which, however, represents only one embodiment example. The figures show.

DESCRIPTION

Figure 1:
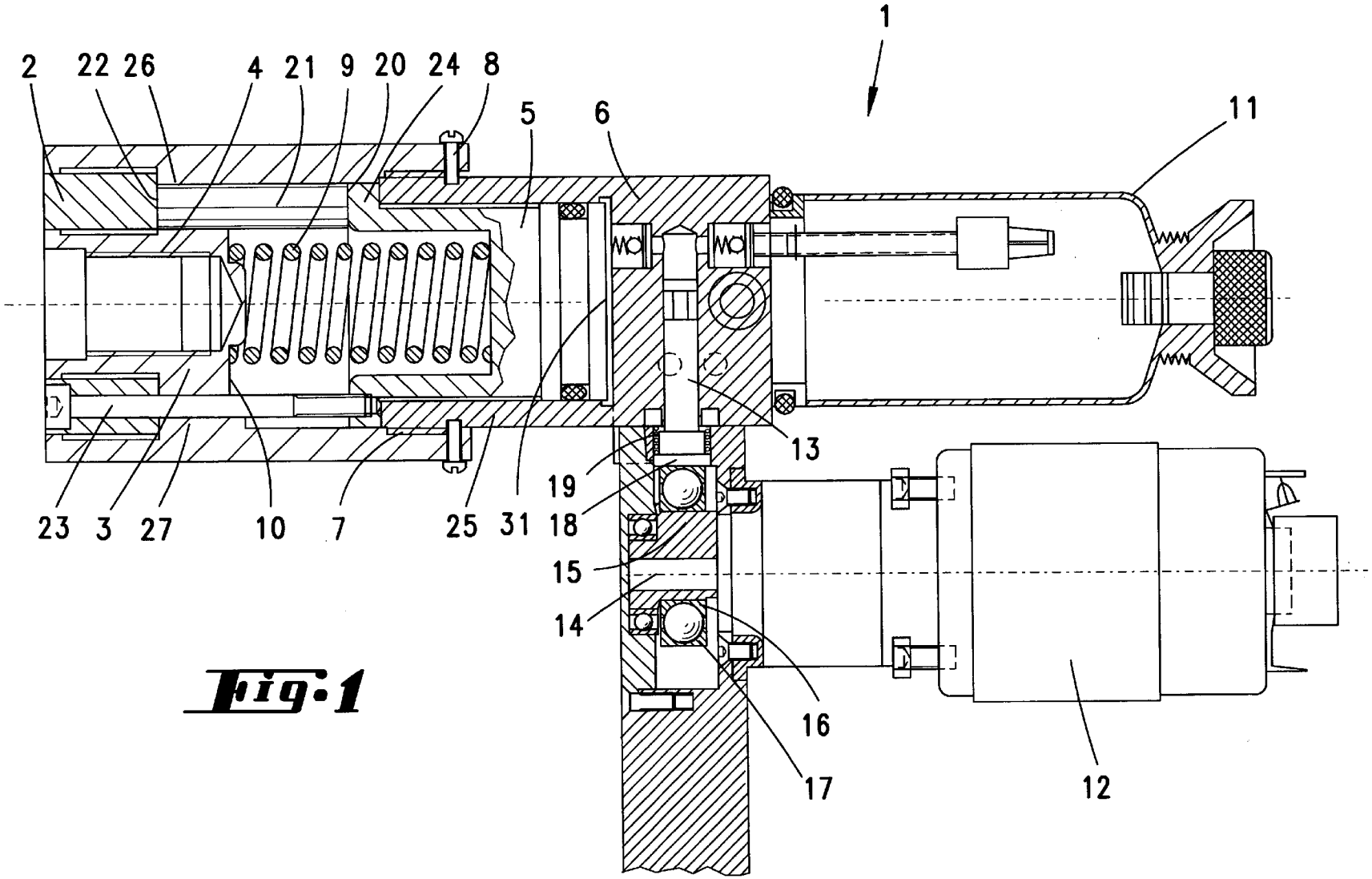
FIG. 1, a cross-sectional representation of the principle of a manual hydraulic apparatus designed as a metal sheet punching apparatus.

The representation and description refer, first with respect to FIG. 1, to a manual hydraulic apparatus 1, with a holding-up part 2 and a fastening installation 3. The fastening installation 3 has an internal threading 4, in which a piercing punch is to be attached in the apparatus according to the embodiment example, which is a metal sheet piercing apparatus.

The holding-up part 2 can be moved with respect to the fastening installation 3, that is it is arranged so it can be moved out. The fastening installation 3, in contrast, should be attached rigidly to a housing 6 of the manual apparatus, specifically by means of a cylindrical housing 25 for a hydraulic piston 5; in the embodiment example, by means of a threading 7 and setting screws 8.

To move the holding-up part 2, the admission pressure is applied to it from the mentioned hydraulic piston 5, which in turn is braced by means of a pressure spring 9 against a bottom side 10 of the fixed holding-up part 3 in its rest position, as represented.

For the admission pressure applied to the hydraulic piston 5, a hydraulic reserve is stored in a container 11 in the manual apparatus 1. The application of pressure occurs, in detail, by means of a pump slide 13 which is driven by an electronic motor 12. The drive occurs by means of a cam 15 which is radially attached to the motor shaft 14. The cam 15 works in cooperation with a ball bearing, where the internal ring 16 of the ball bearing is rigidly connected to the cam, whereas the external ring 17 acts on a bottom side 18 of the pump slide 13. The pump slide 13 is clamped in its bottom position by a pressure spring 19.

In addition, with regard to the design of such a drive, reference is also made to U.S. Pat. Nos. 5,111,681 and 5,195,354. The hydraulic piston 5 possesses, in further detail, a top piston surface 20, against which slide rods 21 are applied, which act on the holding-up part 2. The slide rods 21, with their other ends, are applied against a bottom surface 22 of the holding-up part 2, which is here essentially in the shape of a circular ring.

The holding-up part 2, which is shifted by an angle with respect to the slide rods 21, is rigidly connected to the hydraulic piston 5 by means of holding screws 23.

The fastening screws 23 are, in detail, connected to a ring flange 24 of the hydraulic piston. The ring flange 24 extends in part over the cylindrical housing 25 which is designed so it forms an integral part with the apparatus.

The cylindrical housing 25, on the side of the holding-up part, has an external threading 7, by means of which the fastening installation 3 is connected to the hydraulic apparatus by a screw connection. Accordingly, the fastening installation 3, on the cylindrical housing side, is also designed in the shape of a cylinder, whereas, on the side of the holding-up part, a cylindrical floor or a holding plate is provided. The cylindrical floor is accessible, on the one hand, from the outside by means of a design in the form of a fastening opening with internal threading 4, and it is provided, on the other hand, with passage openings 26, 27 for the slide rods 21 or fastening screws 23. This can also be seen in the cross-sectional representation according to FIG. 4, to which further reference will be made below. In the embodiment example, at an equidistant angular spacing, three slide rods 21 and three fastening screws 23 are provided.

Figure 2:
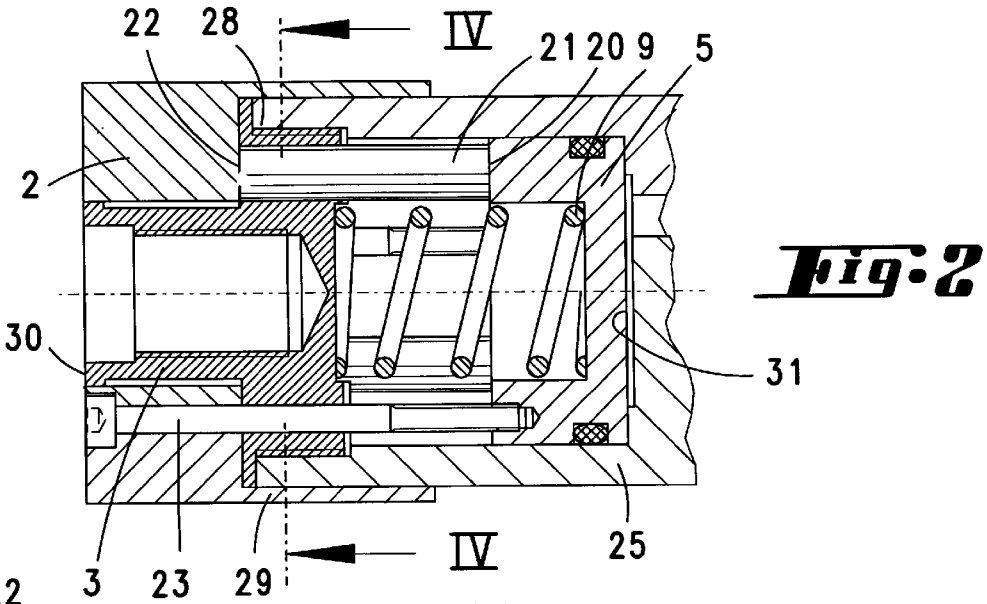
FIG. 2, a cross section through the piston/holding-up part of an apparatus according to FIG. 1, in an alternate embodiment.
Figure 3:
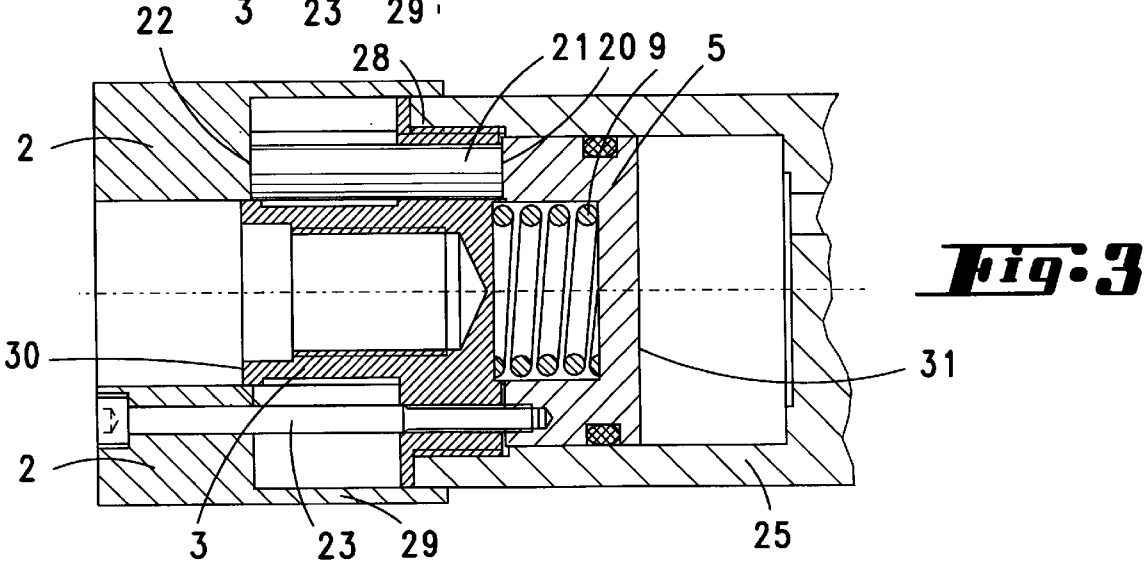
FIG. 3, a view according to FIG. 2, in actuated position.
Figure 4:
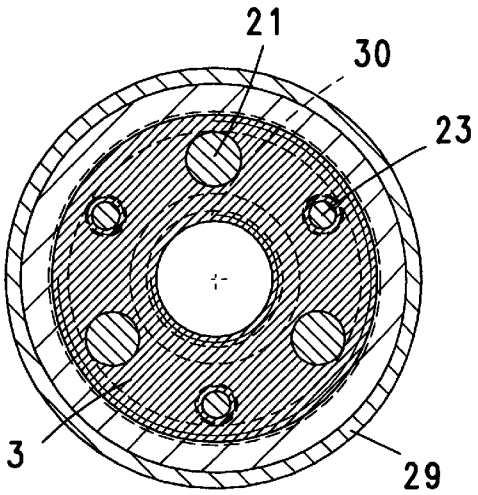
FIG. 4, a cross section through the object according to FIG. 2, cut along line IV—IV.

In FIGS. 2–4, an embodiment variant is represented which differs with regard to the holding-up part. Here the holding-up part is connected by means of an internal threading 28 to the cylindrical housing 25 on the holding-up part side of the cylindrical housing. Furthermore, the holding-up part 2, according to the embodiment variant of FIGS. 2–4, forms an external cover wall 29, which projects in the shape of a cylinder on the side of the housing. The cover wall 29, in the embodiment example, moves outside on the cylindrical housing 25 when the holding-up part receives an actuating stroke. In FIG. 3, the actuated position is represented. Thus, a maximum use is obtained with respect to the external diameter for the holding-up part surface is obtained.

It is apparent from the cross-sectional representation according to FIG. 4 that, and in this regard in agreement with the embodiment variant of FIG. 1, both the slide rods 21 and the fastening screws 23 pass through an external part of the fastening installation 3.

Figure 5:
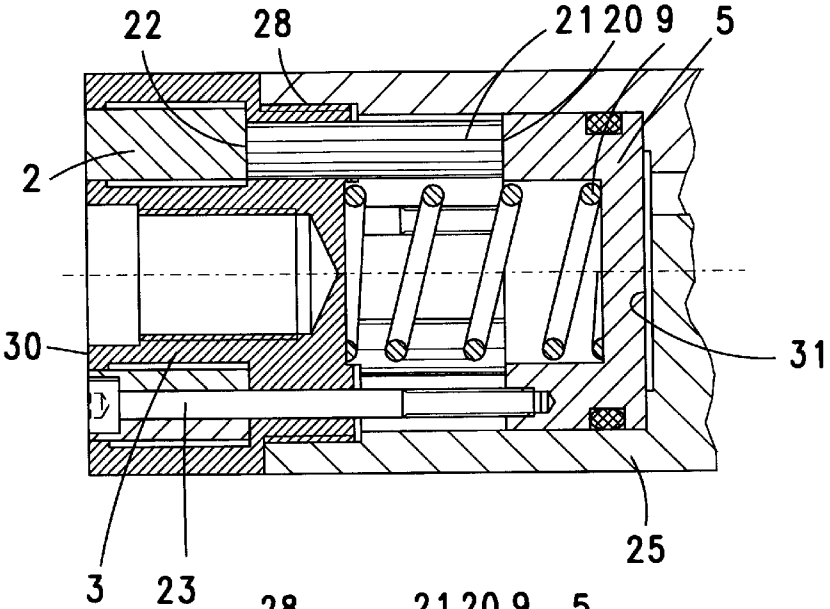
FIG. 5, a representation according to FIG. 2, in an additional alternate embodiment.
Figure 6:
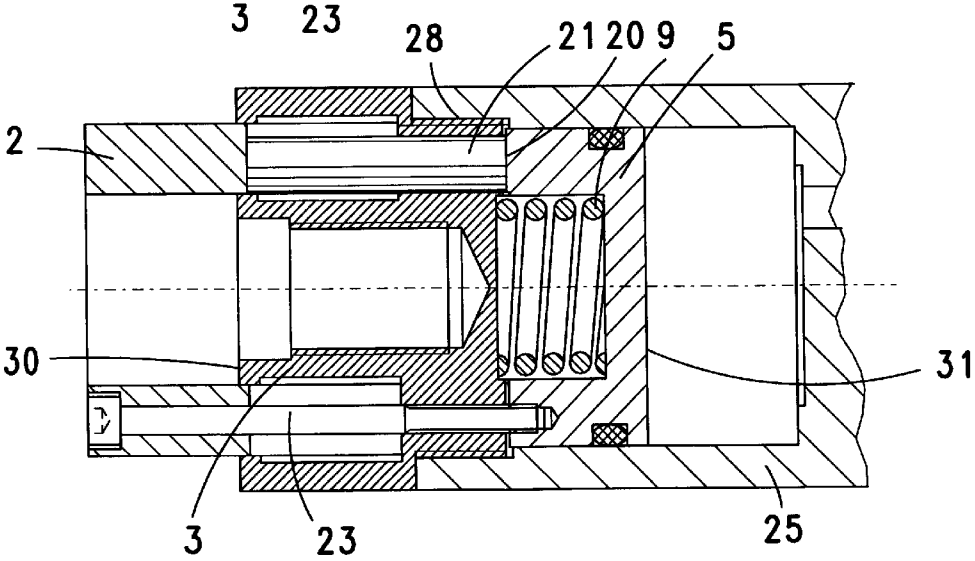
FIG. 6, a representation of the object according to FIG. 5, in the actuated state.

FIGS. 5 and 6 represent an additional modification of the embodiment variant of FIG. 1, and FIGS. 3–4, respectively.

Here there is agreement with the embodiment variant of FIGS. 2–4, except that the apron area 29 is omitted. Instead, the movable holding-up part 2, in agreement in this regard with the embodiment variant of FIG. 1, passes, in a variant in the shape of a circular ring, through a top closing surface 30 of the fastening installation 3.

All the embodiment variants share the feature that the hydraulic piston 5 receives the admission pressure during the working stroke from the hydraulic means, in a direction pointing away from the manual apparatus 1, and over the entire area of the (lower) cross-sectional surface 31.

All the disclosed characteristics are essential to the invention. The entire contents of the disclosures of the related/enclosed priority documents (copy of the preliminary application) are hereby included in the disclosure of the application, including for the purpose of including characteristics of these documents in claims of the present application.

I claim:

1. A manual hydraulic apparatus comprising: a housing; a hydraulic piston which can be moved with respect to said housing; a holding-up part; and a fastening installation rigidly connected to said housing, wherein said holding-up part can be moved by said hydraulic piston with respect to said fastening installation, wherein said hydraulic piston acts by means of pressure means which pass through said fastening installation on the holding-up part.

2. A manual hydraulic apparatus according to claim 1, said holding-up part comprising a circular ring.

3. A manual hydraulic apparatus according to claim 1, wherein said fastening installation is arranged in a central position with respect to said holding-up part.

4. A manual hydraulic apparatus according to claim 1, wherein said holding-up part passes through said fastening installation.

5. A manual hydraulic apparatus according to claim 1, said holding-up part being connected to said hydraulic piston by a screw connection.

6. A manual hydraulic apparatus according to claim 1, said hydraulic piston being braced by means of a spring against said fastening installation in a rest position.

7. A manual hydraulic apparatus according to claim 1, wherein said hydraulic piston can receive an admission force essentially over its entire cross-sectional area.

8. A manual hydraulic apparatus according to claim 1, wherein said pressure means comprises pressure rods.

9. A manual hydraulic apparatus comprising: a housing; a hydraulic piston which can be moved with respect to said housing; a holding-up part; and a fastening installation rigidly connected to said housing, wherein said holding-up part can be moved by said hydraulic piston with respect to said fastening installation, wherein said fastening installation is arranged in a central position with respect to said holding-up part.

10. A manual hydraulic apparatus according to claim 9, said holding-up part comprising a circular ring.

11. A manual hydraulic apparatus according to claim 9, wherein said holding-up part passes through said fastening installation.

12. A manual hydraulic apparatus according to claim 9, wherein said hydraulic piston acts by means of pressure means which pass through said fastening installation on the holding up part.

13. A manual hydraulic apparatus according to claim 9, said holding-up part being connected to said hydraulic piston by a screw connection.

14. A manual hydraulic apparatus according to claim 9, said hydraulic piston being braced by means of a spring against said fastening installation in a rest position.

15. A manual hydraulic apparatus according to claim 9, wherein said hydraulic piston can receive an admission force essentially over its entire cross-sectional area.

16. A manual hydraulic apparatus according to claim 9, wherein said pressure means comprises pressure rods.

17. A manual hydraulic apparatus comprising: a housing; a hydraulic piston which can be moved with respect to said housing; a holding-up part; and a fastening installation rigidly connected to said housing, wherein said holding-up part can be moved by said hydraulic piston with respect to said fastening installation, said holding-up part being connected to said hydraulic piston by a screw connection.

18. A manual hydraulic apparatus according to claim 17, said holding-up part comprising a circular ring.

19. A manual hydraulic apparatus according to claim 17, wherein said fastening installation is arranged in a central position with respect to said holding-up part.

20. A manual hydraulic apparatus according to claim 17, wherein said holding-up part passes through said fastening installation.

21. A manual hydraulic apparatus according to claim 17, wherein said hydraulic piston acts by means of pressure means which pass through said fastening installation on the holding up part.

22. A manual hydraulic apparatus according to claim 17, said hydraulic piston being braced by means of a spring against said fastening installation in a rest position.

23. A manual hydraulic apparatus according to claim 17, wherein said hydraulic piston can receive an admission force essentially over its entire cross-sectional area.

24. A manual hydraulic apparatus according to claim 17, wherein said pressure means comprises pressure rods.

* * * * *